US006877600B2

(12) United States Patent
Sutherland

(10) Patent No.: US 6,877,600 B2
(45) **Date of Patent: *Apr. 12, 2005**

(54) BEVERAGE MULTIPLE PACKAGING LOCK SYSTEM

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/133,026

(22) Filed: Apr. 27, 2002

(65) Prior Publication Data

US 2002/0112973 A1 Aug. 22, 2002

Related U.S. Application Data

(63) Continuation-in-part of application No. 09/690,325, filed on Oct. 17, 2000, now Pat. No. 6,378,697.

(51) Int. Cl.[7] ..... B65D 75/00

(52) U.S. Cl. ..... 206/140; 206/147; 206/434

(58) Field of Search ..... 206/140, 147, 206/427, 434; 229/103.2, 183, 198.2

(56) References Cited

U.S. PATENT DOCUMENTS

| | | | | | |
|---|---|---|---|---|---|
| 3,128,034 | A | * | 4/1964 | Weiss | 206/140 |
| 4,200,220 | A | * | 4/1980 | Ganz | 206/140 |
| 4,708,284 | A | * | 11/1987 | Sutherland et al. | 229/198.2 |
| 5,520,283 | A | * | 5/1996 | Sutherland | 206/434 |
| 5,524,756 | A | * | 6/1996 | Sutherland | 206/434 |
| 5,975,286 | A | * | 11/1999 | Oliff | 206/140 |
| 6,315,697 | B1 | * | 11/2001 | Chen | 482/53 |
| 6,378,697 | B1 | * | 4/2002 | Sutherland et al. | 206/140 |

* cited by examiner

*Primary Examiner*—David T. Fidei

(57) ABSTRACT

This invention relates to a primary and secondary locking system for wrap-around carriers. A secondary male lock is held in the vertical position by a female door flap leaning against the male lock. The adjacent pairs of a primary male lock and corresponding primary female opening and a secondary male lock and corresponding secondary female opening are aligned with each other along a single line.

6 Claims, 3 Drawing Sheets

BEVERAGE MULTIPLE PACKAGING LOCK SYSTEM

This application is a continuation-in-part of application Ser. No. 09/690,325, filed Oct. 17, 2000 now U.S. Pat. No. 6,378,697, of which Robert L. Sutherland and Jean-Manuel Gomes are the inventors.

BACKGROUND OF THE INVENTION

1. Field of the Invention

This invention relates generally to mechanical locks for holding overlapping flaps of a wrap-around carton in place. More particularly, it is a primary lock system and a secondary "backup" locking system.

2. Prior Art

When fabricating a carton from a paperboard blank, opposite ends of the blank are conventionally attached to each other by glue or by a mechanical lock to form the bottom panel of the carton. In the case of a wrap-around carton, flaps located on the ends of the blank typically are overlapped and engaged with one another by mechanical locks formed in the flaps to form the bottom panel of the carton. Since the bottom panel must maintain its integrity throughout the use of the carton, it is essential that the locking system be capable of supporting the weight of the packaged articles, and remain engaged during shipping and handling of the constructed carton.

One approach to provide a stable mechanical lock assembly utilizes both primary and secondary locks. An example of such locking system is disclosed in U.S. Pat. No. 5,443,203 to Sutherland.

SUMMARY OF THE INVENTION

Briefly described, in a preferred form, it is the object of the present invention to provide a secondary lock system that is more secure and does not become accidentally unlocked resulting in the carrier becoming opened discharging the bottles contained therein.

The object of this invention is achieved by providing both primary and secondary lock systems. The primary lock system secures the carrier around the bottles. The secondary system ensures that the primary locks do not become unlocked. The secondary lock system has a male lock that is inserted into the female opening and held in the vertical position in the carrier by a flap in the female lock system. An arcuate tab on this flap aids in holding the secondary male lock in the vertical position.

In addition, each primary male lock is aligned longitudinally with an adjacent secondary male lock located on the carton so as to be directly in front of a bottle contained therein. The primary female opening and female secondary opening are also longitudinally aligned. Thus, all the male locks and female openings are longitudinally aligned.

These and other objects, features, and advantages of the present invention will become more apparent upon reading the following specification in conjunction with the accompanying drawing figures.

DETAILED DESCRIPTION OF THE PREFEERED EMBODIMENTS

The present invention is intended primarily for use with wrap-around carriers containing bottles of the type to contain soft drinks, beer and the like. A typical example of such a bottle has a generally cylindrical body with an upper portion and a bottom, a tapering shoulder smoothly continuous with the upper portion of the body, and a neck formed on the shoulder having a smaller diameter than the body. This conventional bottle B also has a neck flange projecting outwardly from the neck, and a cap attached to the upper end of the neck flange.

Figure 1:
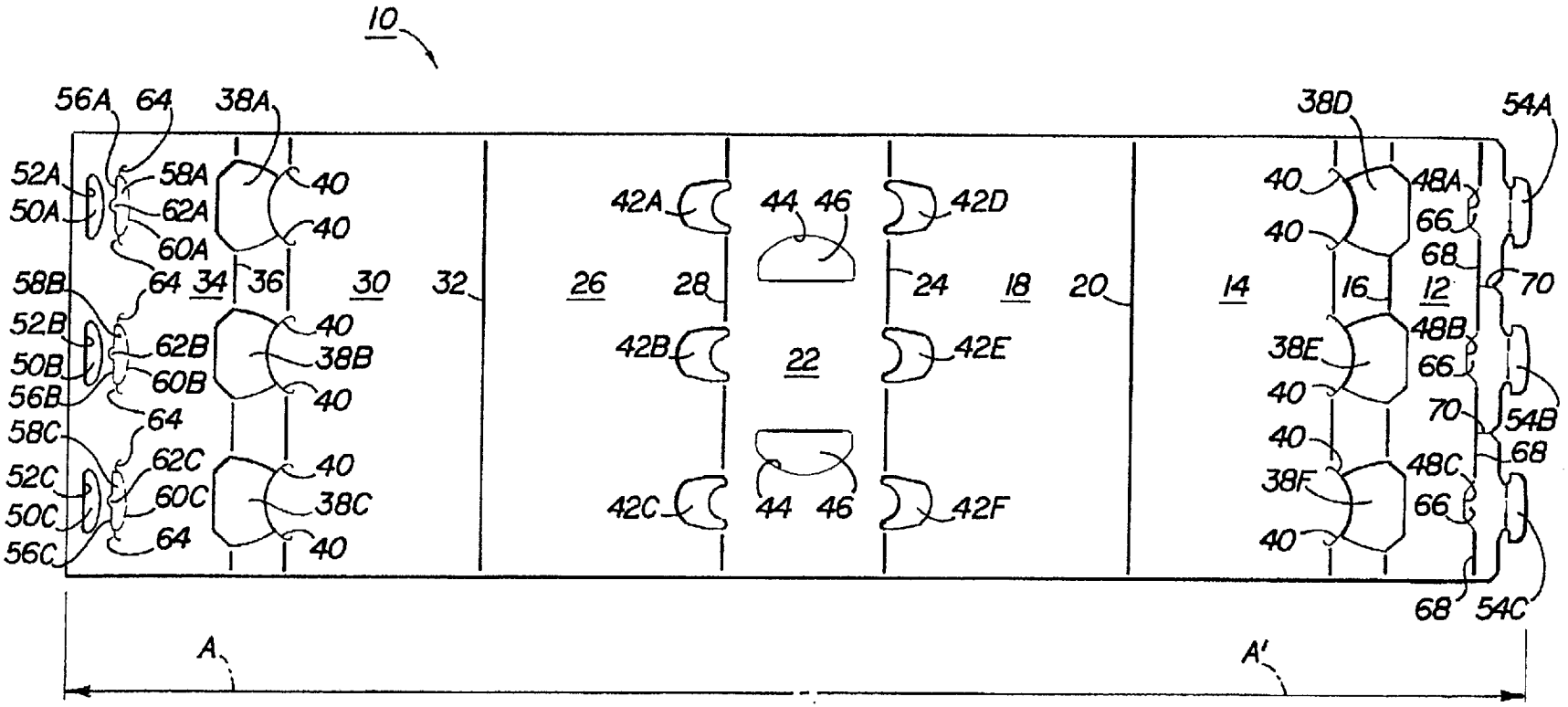
FIG. 1 is a plan view of a blank which incorporates the locking features of the present invention.
Figure 2:
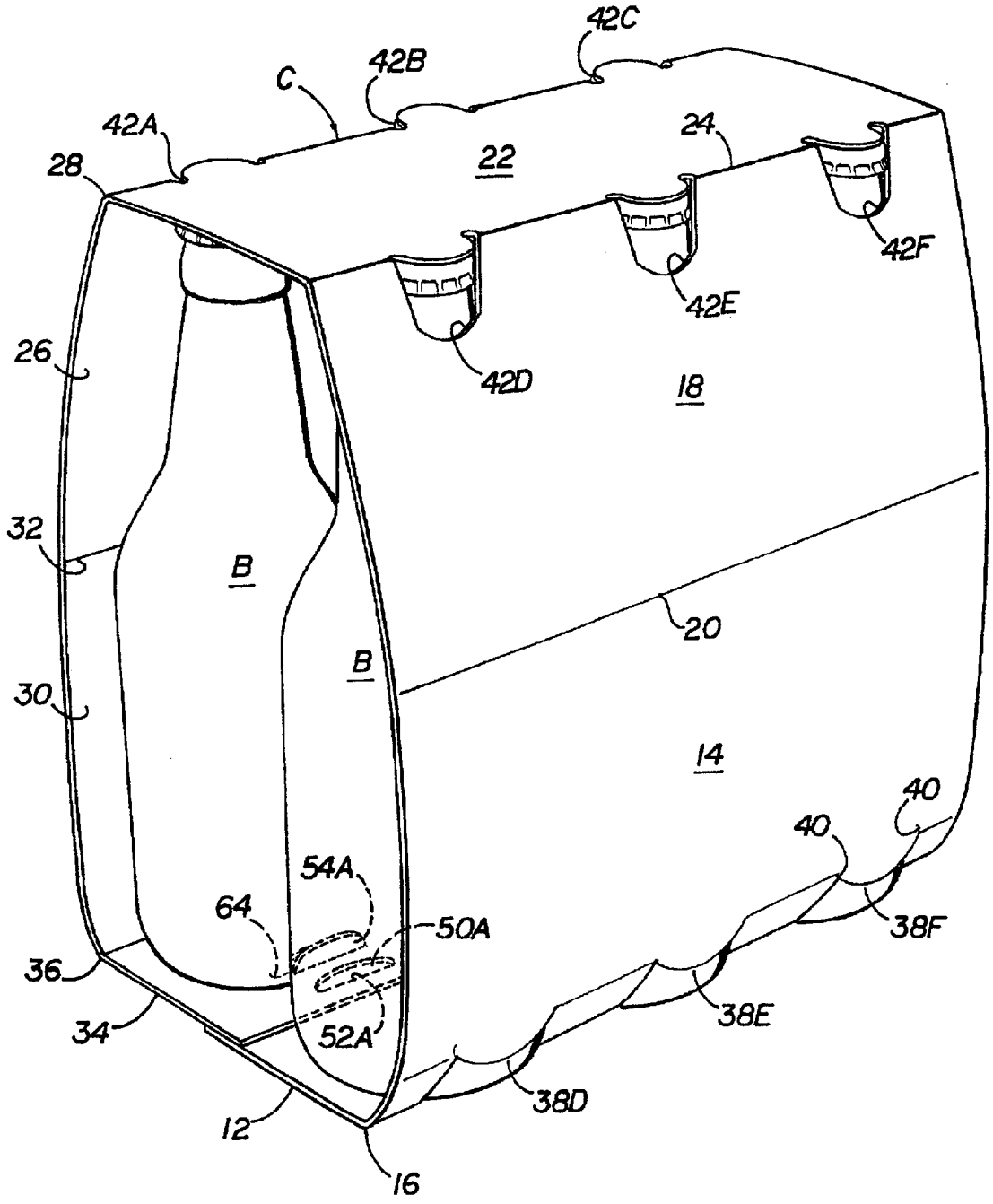
FIG. 2 is a perspective view of the carton formed from the blank of FIG. 1 and loaded with bottles.

The blank for forming the carrier of this invention is illustrated in FIG. 1. This blank 10 is designed to contain six beverage bottles B arranged in two rows of three each. The blank 10 is formed from a foldable sheet of material, such as paperboard. The blank has an outer panel flap 12, which is foldably connected to a lower side panel 14 by fold line 16, and in turn is connected to an upper side panel 18 by fold line 20. Upper side panel 18 is connected to top panel 22 by fold line 24, and in turn connected to upper side panel 26 by fold line 28. Upper side panel 26 is connected to lower side panel 30 by fold line 32. Lower side panel 30 is connected to inner panel flap 34 by fold line 36.

It will be understood by those in the art that the preferable carrier is symmetrical about a horizontal line of bisection, as viewed from FIG. 1. This symmetry aids in the efficient production of the present carrier. The carrier need not have such symmetry, although it is preferred. As shown, the blank 10 is rectangular in shape and includes straight edges, which also makes for an efficient layout of the blank in a web from which the blanks are cut.

The heels of the bottles B may be restrained from movement by the provision of heel apertures 38A–F, or other suitable means for restraining the heels of the bottles from movement within the carrier. These heel apertures 38A–F also permit the carrier to be tightly locked in that a portion of the heel of the bottle B can extend through the heel apertures. These heel apertures are all identical. Slits 40 may be provided around these heel apertures 38A–F to facilitate the projection of the heel of the bottle into the aperture and to prevent tearing of the carrier.

The bottle top apertures 42A–F may be provided in upper side panels 18 and 26 to hold the bottle cap and top of the bottle in position in the carrier.

Finger apertures 44 with finger flaps 46 may be provided in the top panel for carrying the carrier loaded with bottles.

The locking system of the present invention includes both a primary locking system and a secondary locking system. The primary locking system is the locking arrangement between primary male locks 48A–C in outer panel flap 12 and primary female openings 50A–C in the panel flap 34. The primary male locks 48A–C are hooked over primary female ledges 52A–C in the locking of the carrier. As it is important to tighten the carrier tightly about the bottles, primary female openings 50A–C also serve as tightening apertures which allow mechanical tightening fingers to enter and tighten the carrier during forming.

The primary locks connect the ends of the carrier together via the flaps, while secondary locks function to maintain the engaged flaps in place in order to provide a "backup" locking system to prevent the primary locks from separating.

The secondary locking system consists of secondary male locks 54A–C formed as an extension of bottom flap of outer panel flap 12. Secondary female openings 56A–C also represent the cut line for forming the openings to produce female flaps 58A–C. These flaps can be folded around fold lines 60A–C. These flaps may have arcuate tabs 62A–C, whose function will be described infra. These female flaps 58A–C have slits 64 to reduce stress.

It will be noticed that primary male locks 48A and secondary male locks 54A and C are formed in locking flap 66 which is a part of outer panel flap 12 connected fold line 68. Locking flaps 66 has slits 70 to facilitate locking of the locking systems.

It will be noticed each pair of primary and secondary locking locks are lined longitudinally, i.e. the length of the blank. Primary male lock 48A, secondary male lock 54A and primary female opening 50A and secondary female opening 56A are all aligned along the same longitudinal line in the blank as shown in FIG. 1. The blank is formed into a carrier for carrying bottles. The locking systems are aligned longitudinally in the carrier. The line that runs through the carrier and through the bottles that are placed in front of the heel apertures 38A and 38D run through primary lock 48A and secondary male lock 54A and primary female opening 50A and secondary female opening 56A. The importance of this longitudinal alignment will be discussed infra.

Figure 4:
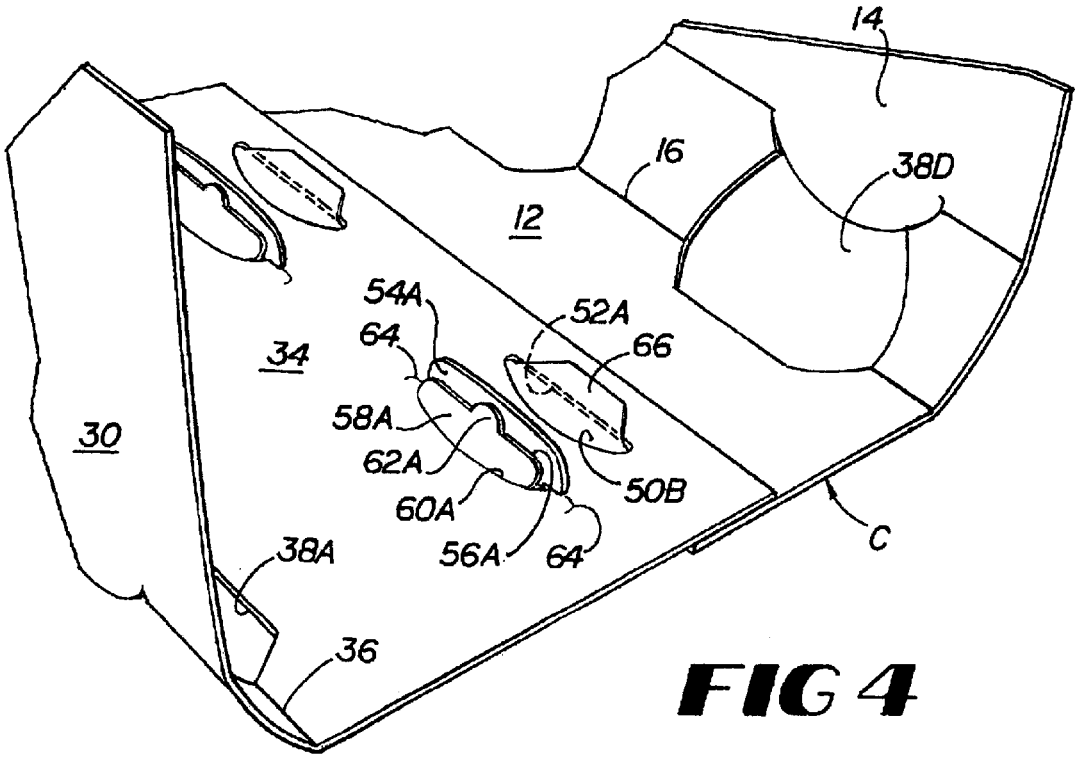
FIG. 4 is the interior view of a carton (c) filled with bottles showing the secondary lock system.

This invention provides a locking system that is more secure than prior art locking systems. While the primary locks connect the ends of the carrier together, the secondary locks keep the primary locks engaged. The secondary locks are secured in that the secondary male locks 54A–C are held in the vertical position in respect to the carrier by secondary female flap 58A–C and arcuate tab 62A–C on the ends of the female flaps 58A–C as illustrated in FIG. 4. If the secondary male locks 54A–C were allowed to be parallel to the outer panel flap 12 and inner panel flap 34, they could easily become disengaged.

The carrier of this invention is formed from the blank of FIG. 1 by moving the top panel 22 of the blank so that a portion of the cap of the bottle and the neck extend through bottle top apertures 42A–F. Blank 10 is pulled tight about the bottles and outer panel flap 12, and inner panel flap 34 are overlapped with outer panel flap 12 being on the outside. Primary male locks 48A–C are punched inwardly into primary female openings 50A–C, and are locked on primary female ledges 52A–C.

The secondary male locks 54A–C are pushed inwardly into the aperture formed when secondary female flaps 58A–C are pushed inwardly by secondary male locks 54A–C.

Secondary male locks 54A–C are held in a vertical position by secondary female flaps 58A–C. The arcuate tab 62A–C on each secondary female flap 58A–C leans against the secondary male lock 54A–C and assists in holding the secondary male lock 54A–C in the vertical position. Holding the secondary male lock 54A–C in the vertical position ensures that the locks are not accidentally withdrawn. The secondary lock system serves the function of ensuring that the primary lock system does not become undone. The holding of the secondary male locks 54A–C by the secondary female flaps 58A–C and arcuate tabs 62A–C is illustrated in FIG. 4.

Figure 3:
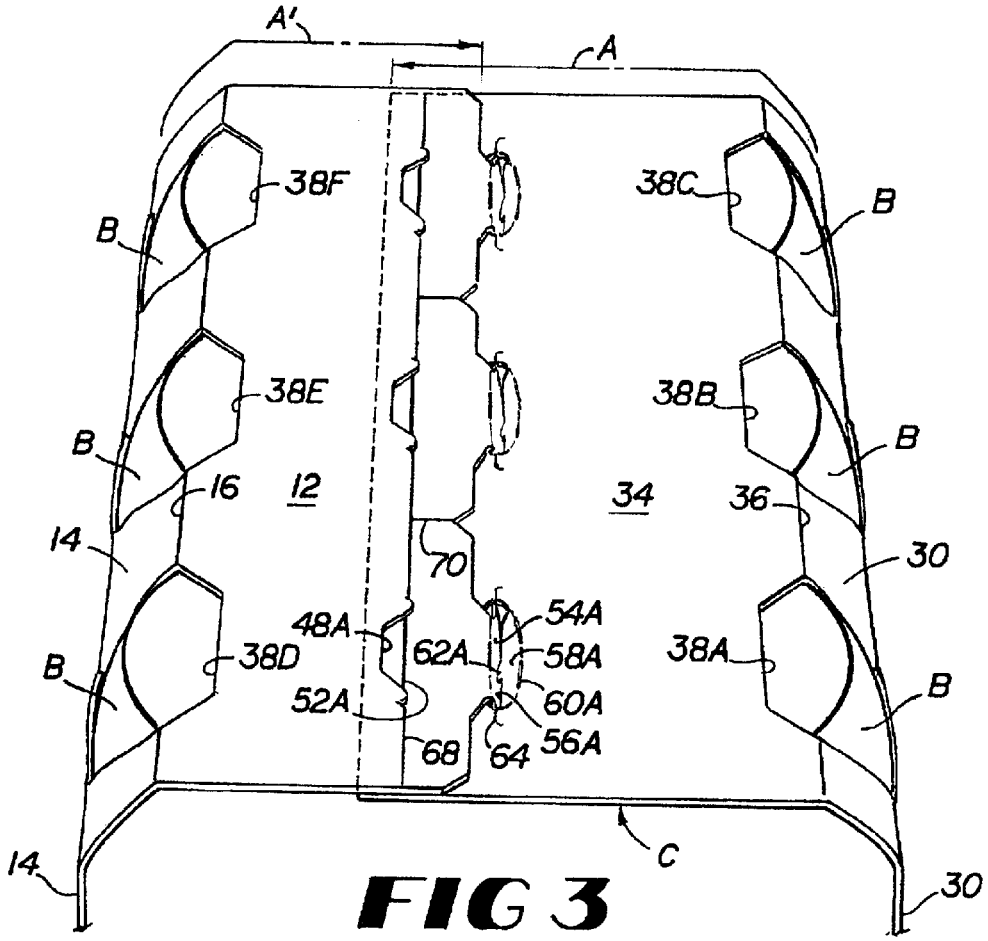
FIG. 3 is a perspective view of the bottom of a carton (c) that has been formed from the blank of FIG. 1 and locked.

It will be noticed from FIG. 3 that the primary locks are aligned along longitudinal lines extending between adjacent bottles. Longitudinal line A–A$^1$ is illustrated in connection with the blank 10 in FIG. 1.

While the invention has been disclosed in its preferred forms, it will be apparent to those skilled in the art that many modifications, additions, and deletions can be made therein without departing from the spirit and scope of the invention and its equivalents as set forth in the following claims.

Unique Features of this Invention

Use of the arcuate tabs on the secondary female flaps faciliate holding the secondary male lock in the vertical position in relation to the bottom of the carrier which makes the accidental unlocking of the carrier far less likely.

Another unique feature of this invention is the longitudinal alignment of each pair of primary and secondary locks and respective female openings. This line extends through the axis of adjacent bottles. This longitudinal alignment results in less likelihood of accidental opening as the locks run along the longitudinal line and not diagonally as is true of most primary and secondary locking systems.

This invention is particularly useful on bottles that have some flexibility such as plastic tubs, PET bottles and composite containers and the like, but it should be understood that the invention is not so limited as it can also be used on glass bottles.

This carrier is designed to be erected a static feedlock system where there are no moving parts with compression fingers pulling the carrier together by the heel apertures. The carrier is pulled together somewhat beyond what is required for locking and then the locking becomes secure as the compression is relaxed.

What is claimed:

1. A wrap-around article carrier for carrying articles comprising:

(a) a top panel, opposite side panels and a bottom panel;

(b) the bottom panel having inner and outer panel flaps, a portion of the outer panel flap overlapping a portion of the inner panel flap;

(c) the inner panel flap having at least one primary female opening with a lock ledge;

(d) the outer panel flap having at least one primary male lock for each lock ledge, formed by a slit cut in the outer panel flap;

(e) the outer panel flap having at least one secondary male lock formed as an extension of the flap;

(f) the inner panel flap having at least one secondary female opening for each secondary male lock, said opening formed by a slit and fold line which forms a flap in the female opening, said flap leaning against the secondary male lock when it has been extended through the female opening to assist in holding the secondary male lock in the vertical position in respect to the outer flap so the lock does not become accidentally disengaged, wherein each flap formed from the secondary female opening has an arcuate tab formed by the slit forming the female opening; and (g) said carrier having a longitudinal dimension running from one side panel to the opposite side panel with each primary lock and longitudinally adjacent secondary male lock and corresponding primary female opening and corresponding secondary female opening being aligned alone a line traversing the longitudinal dimension of the carrier through at least one article contained therein.

2. A wrap-around article carrier for carrying articles comprising:

(a) a top panel, opposite side panels and a bottom panel;

(b) the bottom panel having inner and outer panel flaps, a portion of the outer panel flap overlapping a portion of the inner panel flap;

(c) the inner panel flap having at least one primary female opening with a lock ledge;

(d) the outer panel flap having at least one primary male lock for each lock ledge, formed by a slit cut in the outer panel flap;

(e) the outer panel flan having at least one secondary male lock formed as an extension of the flap;

(f) the inner panel flap having at least one secondary female opening for each secondary male lock, said opening formed by a slit and fold line which forms a flap in the female opening, said flay leaning against the secondary male lock when it has been extended through the female opening to assist in holding the secondary male lock in the vertical position in respect to the outer flap, so the lock does not become accidentally disengaged, wherein the slit forming the flap on the secondary female opening is substantially parallel to and closer to the end of the inner flap than the fold line by which the flap in the female opening is connected to the bottom panel flap; and (g) said carrier having a longitudinal dimension running from one side panel to the opposite side panel with each primary lock and longitudinally adjacent secondary male lock and corresponding primary female opening and corresponding secondary female opening being aligned along a line traversing the longitudinal dimension of the carrier through at least one article contained therein.

3. A bottom panel in an article carrier, said bottom panel being connected to opposite side walls of the carrier, comprising:

(a) inner and outer panel flaps, which are connected to the side walls of the carrier a portion of the outer panel flap overlapping a portion of the inner panel flap;

(b) the inner panel flap having at least one primary female opening with a lock ledge;

(c) the outer panel flap having at least one primary male lock for each lock ledge, formed by a slit cut in the outer panel flap;

(d) the outer panel flap having at least one secondary male lock formed as an extension of the flap;

(e) the inner panel flap having at least one secondary female opening for each secondary male lock, said opening formed by a slit and fold line which forms a flap in the female opening, said flap leaning against the secondary male lock when it has been extended through the female opening to assist in holding the secondary male lock in the vertical position in respect to the outer flap so the lock does not become accidentally disengaged, wherein each flap formed from the secondary female opening has an arcuate tab formed by the slit forming the female opening; and (f) said bottom panel having a longitudinal dimension running from one side wall to the opposite side wall with each primary male lock and longitudinally adjacent secondary male lock and corresponding female opening and corresponding secondary female opening being aligned along a line traversing the longitudinal dimension of the panel.

4. A bottom panel in an article carrier, said bottom panel being connected to opposite side walls of the carrier, comprising:

(a) inner and outer panel flaps, which are connected to the side walls of the carrier a portion of the outer panel flap overlapping a portion of the inner panel flap;

(b) the inner panel flap having at least one primary female opening with a lock ledge;

(c) the outer panel flap having at least one primary male lock for each lock ledge, formed by a slit cut in the outer panel flap;

(d) the outer panel flap having at least one secondary male lock formed as an extension of the flap;

(e) the inner panel flap having at least one secondary female opening for each secondary male lock, said opening formed by a slit and fold line which forms a flap in the female opening, said flap leaning against the secondary male lock when it has been extended through the female opening to assist in holding the secondary male lock in the vertical position in respect to the outer flap so the lock does not become accidentally disengaged, wherein the slit forming the flap on the secondary female opening is substantially parallel to and closer to the end of the inner flap than the fold line by which the flap in the female opening is connected to the bottom panel flap; and (f) said bottom panel having a longitudinal dimension running from one side wall to the opposite side wall with each primary male lock and longitudinally adjacent secondary male lock and corresponding female opening and corresponding secondary female opening being aligned along a line traversing the longitudinal dimension of the panel.

5. A blank for forming a wrap-around carrier comprising a generally rectangular sheet, said sheet comprising:

(a) at one end of the sheet an inner panel flap having at least one primary female opening with a lock ledge and having at least one secondary female opening for each secondary male lock, said opening formed by a slit and fold line which forms a flap in the female opening, wherein each flap formed from a secondary female opening has an arcuate tab formed by a slit forming the female opening; and (b) a side panel, a top panel, and an opposite side panel foldably connected to the inner panel flap in that order;

(c) an outer panel flap foldably connected to the opposite side panel and having at least one primary male lock for each lock ledge in the inner panel flap, said primary lock being formed by a slit cut in the outer panel flap, said outer panel flap having at least one secondary male lock formed as an extension of a flap; and (d) said blank having a longitudinal dimension running from the outer panel flap to the inner panel flap with each primary male lock and longitudinally adjacent secondary male lock and corresponding primary female opening and corresponding secondary female opening being aligned alone a line traversing the longitudinal dimension of the blank.

6. A blank for forming a wrap-around carrier comprising a generally rectangular sheet, said sheet comprising:

(a) at one end of the sheet an inner panel flap having at least one primary female opening with a lock ledge and having at least one secondary female opening for each secondary male lock, said opening formed by a slit and fold line which forms a flap in the female opening, wherein the slit forming the flap on the secondary female opening is substantially parallel to and closer to the end of the inner flap than the fold line, by which the flap in the female opening is connected to the bottom panel flap; and (b) a side panel, a top panel, and an opposite side panel foldably connected to the inner panel flap in that order;

(c) an outer panel flap foldably connected to the opposite side panel and having at least one primary male lock for each lock ledge in the inner panel flap, said primary lock being formed by a slit cut in the outer panel flap, said outer panel flap having at least one secondary male lock formed as an extension of a flap; and (d) said blank having a longitudinal dimension running from the outer panel flap to the inner panel flap with each primary male lock and longitudinally adjacent secondary male lock and corresponding primary female opening and corresponding secondary female opening being aligned along a line traversing the longitudinal dimension of the blank.

* * * * *